US008728608B2

(12) United States Patent
Maisch

(10) Patent No.: US 8,728,608 B2
(45) Date of Patent: May 20, 2014

(54) PROFILE ELEMENT WITH A SEALING ELEMENT

(75) Inventor: Christof Maisch, Gaggenau (DE)

(73) Assignee: Protektorwerk Florenz Maisch GmbH & Co. KG, Gaggenau (DE)

( * ) Notice: Subject to any disclaimer, the term of this patent is extended or adjusted under 35 U.S.C. 154(b) by 860 days.

(21) Appl. No.: 12/668,748

(22) PCT Filed: Jul. 9, 2008

(86) PCT No.: PCT/EP2008/005609
§ 371 (c)(1),
(2), (4) Date: Jan. 29, 2010

(87) PCT Pub. No.: WO2009/010221
PCT Pub. Date: Jan. 22, 2009

(65) Prior Publication Data

US 2010/0167008 A1 Jul. 1, 2010

(30) Foreign Application Priority Data

Jul. 13, 2007 (DE) ..... 10 2007 032 770

(51) Int. Cl.
*B32B 3/24* (2006.01)
*B29C 45/14* (2006.01)

(52) U.S. Cl.
USPC ..... 428/139; 428/140; 264/273; 264/274

(58) Field of Classification Search
USPC ..... 428/139, 140; 264/273, 274
See application file for complete search history.

(56) References Cited

U.S. PATENT DOCUMENTS

| | | | | |
|---|---|---|---|---|
| 3,757,480 | A | | 9/1973 | Young |
| 4,139,664 | A | * | 2/1979 | Wenrick ..... 428/31 |
| 5,040,803 | A | * | 8/1991 | Cieslik et al. ..... 277/316 |
| 5,275,420 | A | * | 1/1994 | Rodenkirch ..... 277/313 |

(Continued)

FOREIGN PATENT DOCUMENTS

| | | |
|---|---|---|
| AT | 410 238 B | 10/2008 |
| AT | 410 238 T | 10/2008 |

(Continued)

OTHER PUBLICATIONS

Transition of the International Preliminary Report on Patentability dated Jan. 28, 2010. PCT/EP2008/005609.

(Continued)

*Primary Examiner* — William P Watkins, III
(74) *Attorney, Agent, or Firm* — Gifford, Krass, Sprinkle, Anderson & Citkowski, P.C.

(57) ABSTRACT

The invention relates to a profile element, in particular a construction profile, for example a dry construction profile, a profile for facades or a rendering profile, comprising, in particular a metallic profile body (17, 18) and at least one sealing element (9, 10, 11). Said sealing element is fixed. at least to a longitudinal side of the profile body and is made of a plastic. Openings (13) are embodied in. the longitudinal side of the profile body and the sealing element comprises projections (12) that are embodied as a single piece with the sealing elements for fixing to the profile body (17, 18, 20) on the side of said sealing elements that face the profile body (17, 18, 20), said projections protruding through the openings. The invention also relates to a method for producing said type of profile element.

24 Claims, 2 Drawing Sheets

(56) References Cited

U.S. PATENT DOCUMENTS

Figure 1:
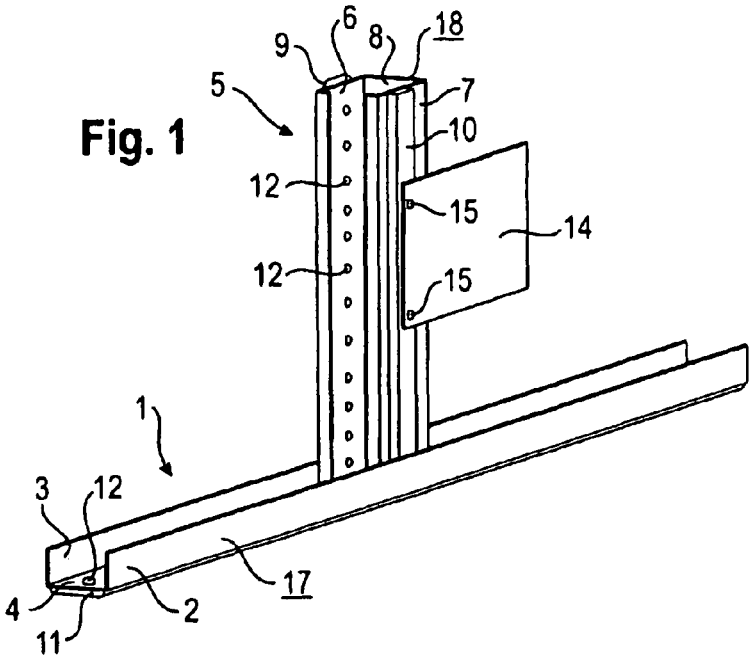

| | | | | |
|---|---|---|---|---|
| 5,382,397 | A * | 1/1995 | Turner, Jr. | 264/46.5 |
| 7,235,286 | B2 * | 6/2007 | Salameh | 428/139 |
| 2002/0160149 | A1 * | 10/2002 | Garofalo | 428/139 |

FOREIGN PATENT DOCUMENTS

| | | | |
|---|---|---|---|
| DE | 1 659 469 | A | 1/1971 |
| DE | 1 659 469 | A1 | 1/1971 |
| DE | 2 244 073 | A1 | 3/1974 |
| DE | 150 121 | | 8/1981 |
| DE | 41 07 743 | A1 | 1/1992 |
| DE | 41 37 241 | C2 | 5/1993 |
| DE | 43 16 931 | A1 | 11/1994 |
| DE | 44 06 755 | A1 | 6/1995 |
| DE | 196 40 633 | A1 | 3/1998 |
| DE | 198 02 203 | A1 | 8/1999 |
| DE | 198 43 597 | C1 | 3/2000 |
| DE | 41 37 241 | A1 | 4/2002 |
| DE | 101 47 692 | A1 | 4/2002 |
| DE | 697 16 193 | T2 | 6/2003 |
| DE | 10 2004 037 093 | A1 | 3/2006 |
| DE | 10 2004 040 589 | A1 | 4/2006 |
| DE | 20 2006 015 852 | U1 | 12/2006 |
| EP | 0 013 012 | A1 | 7/1980 |
| EP | 0 013 012 | B1 | 7/1980 |
| EP | 0 364 761 | B1 | 4/1990 |
| EP | 0 364 768 | A1 | 4/1990 |
| EP | 0 989 251 | A2 | 3/2000 |
| EP | 0 989 251 | A3 | 3/2000 |
| EP | 1 032 065 | A2 | 8/2000 |
| EP | 1 032 065 | B1 | 8/2000 |
| EP | 0 989 251 | A2 | 3/2009 |
| GB | 2 395 495 | A | 5/2004 |
| WO | WO-97/06318 | A1 | 2/1997 |
| WO | WO-02/092930 | A1 | 11/2002 |
| WO | WO-2005/031080 | A1 | 4/2005 |

OTHER PUBLICATIONS

German Search Report dated Mar. 5, 2008, DE 10 2007 032 770.8.

International Search Report dated Oct. 10, 2008, PCT/EP2008/005609.

* cited by examiner

BERICHTIGTES BLATT (REGEL 91)
ISA/EP

PROFILE ELEMENT WITH A SEALING ELEMENT

CROSS-REFERENCE TO RELATED APPLICATIONS

This application is the U.S. national phase of PCT/EP2008/005609 filed Jul. 9, 2008, which claims priority of German Patent Application No. 10 2007 032 770.8 filed Jul. 13, 2007.

The present invention relates to a section element, in particular a structural section, for example a dry construction section, a facade section or a plastering section, having a section body in particular of metal and at least one sealing element which is fastened to at least a longitudinal side of the section body.

Section elements of this type are used, for example, in dry construction as upright sections, floor sections or wall sections to serve as holders for dry walls or for the plankings of walls. For example, U sections are usually used as floor sections or ceiling sections into which in turn C sections are usually inserted as upright sections to whose limbs the plankings of the dry wall are ultimately fastened.

To achieve a sealing with respect to the floor, the ceiling or the wall for the sections to be fastened to the floor, the ceiling or the wall, it is known to provide the sections with self-adhesive sealing elements such as felt strips at the contact surfaces before installing the sections. These sealing elements effect a compensation of unevenness of the floor, of the ceiling or of the wall so that both an improved soundproofing and an improved thermal insulation is achieved and it is also prevented, for example in the event of a fire, that smoke can penetrate through joints located between the sections and the floor, the ceiling or the wall.

It is disadvantageous in this solution that the sealing elements have to be applied to the section by the fitter at the construction site, whereby an additional processing step is required at the construction site and the work effort is increased.

It is therefore an object of the present invention to provide a section element of the initially named kind which can be manufactured more simply and with less effort and/or cost.

Starting from a section element of the initially named kind, this object is satisfied in accordance with the invention in that the sealing element is made of plastic; in that openings are formed in the longitudinal side of the section body; and in that the sealing element has protrusions for the fastening to the section body at its side facing the section body which are formed in one piece with the sealing element and which project through the openings.

Such sealing elements can already be fastened to the section elements during the manufacture thereof so that section elements already provided with sealing elements can be delivered to the construction site and can be used by the fitter without further process steps. The sealing elements can already be fastened to the section elements during the shaping process carried out for the manufacture of the section elements or subsequently thereto, but still in connection with the manufacture of the section elements so that the section elements are already provided with the sealing elements after leaving the manufacturing facility.

In accordance with the invention, this is in particular achieved in that the sealing element is sprayed, rolled or extruded onto the section body. In this case, the sealing element is thus not yet in the finished condition on the manufacture of the section element, but rather in an intermediate condition which can, for example, be liquid to very viscous. Whereas a prefabricated sealing element such as a felt strip cannot be connected with sufficient precision to the section body or can only be connected with a very high effort and/or cost due to the high process speeds which are present on the manufacture of the section element, which can amount to up to 150 m/min, for example, the application by spraying, rolling or extruding, for example, is also possible very precisely and with a relatively low effort and/or cost at such high speeds and in this connection in particular also in a continuous process. It is furthermore achieved by the application of the sealing element which is not in the solid condition on the manufacture of the section element that the liquid to viscous plastic material of the sealing element passes through the openings formed in the section body, whereby a fastening of the sealing element to the section body is achieved by these protrusions formed in one piece with the sealing element and projecting through the openings.

Depending on the kind of application and the further treatment, the protrusions can at least partly form undercuts with the material of the section body so that an even better fastening is ensured. This can be achieved, for example, in that the plastic is foamed after application to the base body, with the ends of the protrusions projecting through the openings expanding and thereby forming the undercuts.

In accordance with a further advantageous embodiment of the invention, the sealing element is fastened to the section body due to inherent material properties of the plastic in addition to the fastening by means of the protrusions projecting through the openings. Particularly on the application by spraying, rolling or extrusion, the sealing element is in an aggregation state in which an adhesion to the section body is achieved. The fastening of the sealing element to the section body achieved by the protrusions is thus further improved by this adhesion.

In accordance with a further preferred embodiment of the invention, the sealing element is provided at the outer side of the section body. The desired sealing with adjacent objects such as the floor, the wall or the ceiling can thereby be achieved.

The section element can have any desired cross-section, but is preferably formed as a C-section, U-section, Z-section, L-section or T-section. A design with a closed geometry is also possible.

In accordance with a further preferred embodiment of the invention, the section element is designed as a U-section or as a C-section with two limbs and a base portion disposed therebetween, with the sealing element being provided at the base portion and/or at least one of the limbs. If the section element is formed, for example, as a U-section, in which the sealing element is fastened to the outer side of the base portion, a very good sealing toward the floor or the ceiling is achieved on the use of the section element as a floor section or as a ceiling section. On the use as a C-shaped upright section, in contrast, the two limbs can, for example, each be provided with sealing elements at their outer side so that the sealing elements act as soundproofing between the upright section and the plates to be fastened to the section elements. It is advantageous if the sealing element has soundproofing and/or thermal insulating properties.

The sealing element is preferably designed as flexible or sealing to easily compensate corresponding unevenness at adjacent objects, for example.

In accordance with a further advantageous embodiment of the invention, the sealing element increases its volume on the exceeding of a preset temperature in that it foams, for example. It is, for example, achieved by the selection of a material reacting accordingly to high temperatures that, in the event of fire, the sealing element completely fills up any possibly still present joints so that a spread of smoke past the section element is reliably prevented.

The sealing element preferably extends substantially over the total length of the section body. A sealing over the total section length is thereby achieved. It is also possible in dependence on the application that the sealing element extends only over part regions of the section body. The sealing element can, for example, be formed as a sealing cord and thus in particular have an approximately circular or oval cross-section.

In accordance with a further preferred embodiment of the invention, the sealing element substantially extends over the total width of the longitudinal side of the section body. A particularly good sealing is thereby achieved. It is, however, also possible that the sealing element only extends over a part of the width of the longitudinal side of the section body. In this case, a plurality of sealing elements, in particular extending substantially parallel to one another, can advantageously be fastened to the section body. In this manner, sealing material is saved and any special shapes of the section body which may be present, for example grooves or other recesses or elevated portions, can be taken into account.

In accordance with an advantageous embodiment of the invention, the sealing element is made of a foamed plastic. The material of the sealing element can be brought into its final aggregate state by the foaming, with a volume increase, which is desired, for example, being able to take place simultaneously.

The sealing element preferably comprises a soft plastic, PVC, in particular soft PVC. Any existing unevenness of the adjacent objects can be easily compensated by the design as a soft plastic so that the desired sealing properties can be achieved. The use of PVC is advantageous, for example, since PVC has a high temperature resistance, on the one hand, and only a small water absorption ability, on the other hand, and can be both sprayed on and extruded on easily. The resistance to temperature, water and UV is important in this respect since the section elements formed In accordance with the invention are frequently stored outdoors.

In accordance with a further advantageous embodiment of the invention, the sealing element has a thickness of approximately. 0.1 mm to 10 mm, preferably from approximately 3 mm to 5 mm. It is ensured by a corresponding thickness of the sealing element that larger unevenness in the surface of the objects to which the selection is fastened is also reliably compensated.

Further preferred embodiments of the invention are set forth in the dependent claims.

Figure 2:
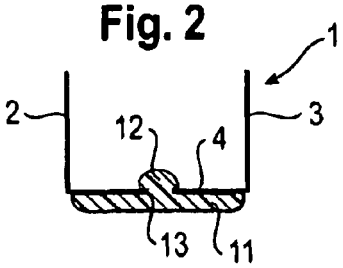
Figure 3:
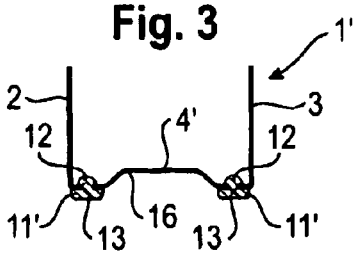
Figure 4:
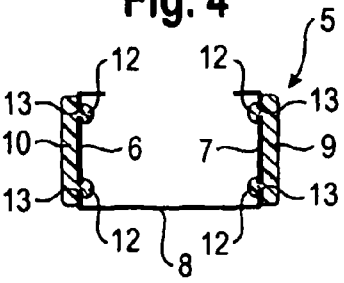
Figure 5:
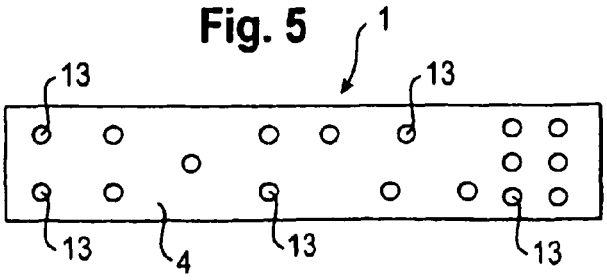
Figure 6:
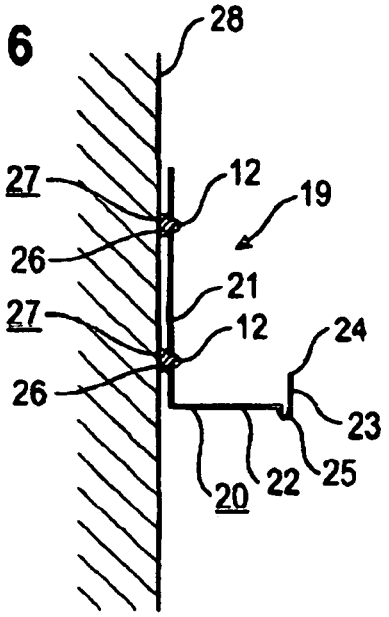
Figure 7:
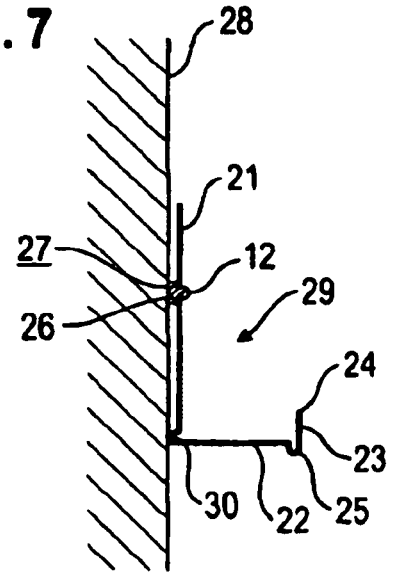

The invention will be described in more detail in the following with reference to an embodiment and to the drawing; there are shown in this:

FIG. 1 a perspective representation of a U-section formed in accordance with the invention and of a C-section formed in accordance with the invention;

FIG. 2 a cross-section through the U-section in accordance with FIG. 1;

FIG. 3 a cross-section through a further embodiment of a U-section formed in accordance with the invention FIG. 4 a cross-section through the C-section in accordance with FIG. 1, FIG. 5 an inner view of the C-section in accordance with FIG. 1;

FIG. 6 a cross-section through a base section formed In accordance with the invention; and FIG. 7 a cross-section through a further base section formed in accordance with the invention.

FIG. 1 shows a U-section 1 which includes a section body 17 with two limbs 2, 3 and a base portion 4 connecting the two limbs 2, 3. The U-section is in this respect arranged lying on the floor, not shown, such that the inner space of the U-section 1 present between the two limbs 2, 3 is upwardly open.

A C-section 5 standing perpendicular is inserted between the limbs 2, 3 and forms the base construction for an upright wall in dry construction together with the U-section 1 and further C-sections, not shown.

The C-section 5 includes a section body 18 with two limbs 6, 7 which are connected to one another by a base portion 8 disposed therebetween. The two free longitudinal sides of the limbs 6, 7 are inwardly turned over in a known manner so that the C-shaped cross-section of the C-section 5 results.

Respective elongated sealing elements 9, 10 are fastened to the outsides of the limbs 6, 7 and extend as sealing strips over the total length and over the large part of the width of the limbs 6, 7. An elongated sealing element 11 is fastened in a similar manner to the outside of the base portion 4 of the U-section 1 and extends over the total length of the U-section 1 and substantially over its width.

A sealing is provided by the sealing element 11 between the U-section 1 and the floor on which the U-section lies.

At their sides facing the C-section 5 or the U-section 1, the sealing elements 9, 10, 11 have protrusions 12 which are in each case formed in one piece with the sealing element 9, 10, 11 and which project through openings (13) formed in the limbs 6, 7 and in the base portion 4 (see FIGS. 2-5) into the respective interior of the U-section 1 or of the C-section 5, whereby the sealing elements 9, 10, 11 are fastened to the U-section 1 or to the C-section 5.

In addition to this fastening, the sealing elements 9, 10, 11 are in adhesive connection with the outsides of the limbs 6, 7 or of the base portion 4 since the sealing elements 9, 10, 11 were applied, in particular sprayed, rolled or extruded, in a liquid or viscous condition onto the surface of the limbs 6, 7 or of the base portion 4 during the manufacture of the sections 1, 5 so that an adhesive connection was produced between the sealing elements 9, 10, 11 and the section bodies 17, 18. Subsequently to this, the sealing elements 9, 10, 11 were dried or hardened or foamed, which can take place by heating in a drying oven, for example.

Due to the liquid or viscous consistency of the material of the sealing elements 9, 10, 11 on the application onto the section bodies 17, 18, some of the material passes through the openings 13 on the manufacture of the sections, whereby the inwardly projecting protrusions 12 are formed. On the hardening or foaming, the material of the sealing elements 9, 10, 11 expands so that the layer provided at the outside of the section bodies 17, 18 is given the desired thickness and, on the other hand, the inwardly projecting protrusions 12 form undercuts with the section bodies 17, 18, as can in particular be recognized from FIGS. 2 to 4.

A plate 14 is furthermore shown in FIG. 1 which is fastened to the limb 7 of the C-section 5 in a customary manner, for example by screws 15. The plate 14 is in this respect screwed to the C-section 5 so that it is not in direct contact with the C-section, but rather contacts the sealing element 10. The sealing element 10 thus forms a soundproofing between the C-section 5 and the plate 14. An upright wall with very good soundproofing and/or thermal insulation properties can thus be produced by further plates 14, not shown, and further C-sections 5, not shown. Disadvantageous heat bridges or cold bridges can thus be reliably prevented.

Different cross-sections of U-shaped or C-shaped section elements are shown in FIGS. 2 to 4. Whereas the U-section 1 in accordance with FIG. 1, in which the outside of the base portion 4 is substantially fully covered by the sealing element 11, is shown in FIG. 2, FIG. 3 shows a U-section 1' with a base portion 4' which has a portion 16 projecting inwardly in its center region. A respective two thinner, strip-shaped sealing elements 11' which are connected to the U-section 1' in the same manner as the sealing element 11 are arranged at the outside of the base portion 4'.

In the C-section 5 shown in FIG. 4, the sealing elements 9, 10 are each provided with two protrusions 12, which are disposed next to one another viewed over the width and which project through corresponding openings 13 disposed next to one another, The plan view of the base portion 4 of the U-section 1 with different arrangements of openings 13 is shown by way of example in FIG. 5. The different arrangements can naturally be used in any desired combinations both for the U-section 1 and for the C-section 5.

FIG. 6 shows a cross-section through a base section 19 which is formed in accordance with the invention and which includes an L-shaped section body 20 with a base portion 21 and an edge closure portion 22 angled perpendicular thereto. An end-side turnover 23, by which a pull-off edge 24 as well as a drip edge 25 of the base section are formed, is formed at the front edge of the edge closure portion 22.

Two sealing elements 27 which are formed as sealing cords 26 and which form a seal with respect to a wall portion 28 are provided at the rear side of the base portion 21. The fastening of the base section 19 to the wall portion 28 can in this respect take place in a known manner, for example by cementing or also by a screw connection or by an adhesive bond. The sealing elements 27 can extend substantially parallel to the longitudinal extent of the base section 19. An extent deviating from this is generally also possible, for example an S-shaped extent or a zigzag extent. The fastening of the sealing elements 27 in this respect takes place in accordance with the method described with respect to FIGS. 1 to 4.

FIG. 7 shows a base section 29 which is formed in accordance with the base section 19, but in which only one sealing element 27 formed as a sealing cord 26 is provided. A contact edge 30 is provided at the lower end of the base portion 21; it is formed as a stamping and its depth substantially corresponds to the thickness of the sealing cord 26 so that the base portion 21 of the base section 29 mounted at the wall portion 28 extends substantially parallel to the wall portion 28.

The invention is not limited to dry construction sections, but can rather be used everywhere section elements with sealing elements are used. The use as a structural section, for example as a dry construction section or as a plastering section or facade section, e.g. in the form of corner sections, base sections, connection sections, terminal sections, joint sections or venting sections, is, however, preferred. The section body can furthermore be manufactured from metal, from plastic or from any other suitable material.

The invention claimed is:

1. A section element having a section body made of a sheet material and at least one sealing element which is fastened to at least a longitudinal side of the section body, wherein the sealing element is made of plastic;

characterized in that openings are formed in the longitudinal side of the section body; in that, at its side facing the section body, the sealing element has protrusions for the fastening to the section body which are formed in one piece with the sealing element and which project through the openings; and in that the sealing element is made from a foamed plastic such that the foamed plastic extends through said openings and overlies a portion of a side of said section body and forms said protrusions.

2. A section element in accordance with claim 1, characterized in that the protrusions at least partly form undercuts with the material of the section body.

3. A section element in accordance with claim 1, characterized in that the sealing element is fastened to the section body on the basis of material properties inherent in the plastic in addition to the fastening by means of the protrusions projecting through the openings.

4. A section element in accordance with claim 1, characterized in that the sealing element is sprayed, rolled or extruded onto the section body.

5. A section element in accordance with claim 1, characterized in that the sealing element is provided at the outside of the section body.

6. A section element in accordance with claim 1, characterized in that the section element is formed as a C-section, a U-section, a Z-section, an L-section or a T-section or with a section closed in cross-section.

7. A section element in accordance with claim 1, characterized in that the section element is formed as a U-section or as a C-section with two limbs and a base portion disposed therebetween; and in that the sealing element is provided at the base portion and/or at at least one of the limbs.

8. A section element in accordance with claim 1, characterized in that the sealing element has soundproofing and/or thermal insulation properties.

9. A section element in accordance with claim 1, characterized in that the sealing element is formed as flexible or elastic.

10. A section element in accordance with claim 1, characterized in that the sealing element enlarges its volume on exceeding of a preset temperature.

11. A section element in accordance with claim 1, characterized in that the sealing element substantially extends over the total length of the section body.

12. A section element in accordance with claim 1, characterized in that the sealing element substantially extends over the total width of the longitudinal side of the section body.

13. A section element in accordance with claim 1, characterized in that the sealing element only extends over a part of the width of the longitudinal side of the section body.

14. A section element in accordance with claim 1, characterized in that the sealing element is formed as a sealing cord.

15. A section element in accordance with claim 1, characterized in that a plurality of sealing elements are fastened to the section body.

16. A section element in accordance with claim 1, characterized in that the sealing element is made from a soft plastic.

17. A section element in accordance with claim 1, characterized in that the sealing element is made from PVC.

18. A section element in accordance with claim 1, characterized in that the sealing element has a thickness of approximately 0.1 mm to 10 mm, preferably from approximately 3 mm to 5 mm.

19. A method for the manufacture of a section element having a section body made of a sheet material and at least one sealing element which is fastened to at least a longitudinal side of the section body, wherein the sealing element is made of plastic, wherein openings are formed in the longitudinal side of the section body; wherein, at its side facing the section body, the sealing element has protrusions for the fastening to the section body which are formed in one piece with the sealing element and which project through the openings; and wherein the sealing element is made from a foamed plastic said method comprises the steps of applying the sealing element to the section body during the manufacture of the section element, and thereafter foaming the sealing element after application onto the section body so that said foamed sealing element extends through said openings and overlaps a portion of a side of said section body opposite from said sealing element to thereby form said protrusions.

20. A method in accordance with claim 19, characterized in that the sealing element is sprayed, rolled or extruded onto the section body.

21. A method in accordance with claim 19, characterized in that the sealing element is applied to the section body in a continuous process.

22. A method in accordance with claim 19, characterized in that the sealing element is fastened to the section body during a shaping process carried out for the manufacture of the section element or subsequently thereto.

23. A method in accordance with claim 19, characterized in that sealing element is applied to the section body in a liquid to viscous condition.

24. A method in accordance with claim 23, characterized in that the sealing element is applied to the section body so that at least some of the openings formed in the section body are covered at least regionally by the sealing element, and in that the liquid to viscous material of the sealing element passes through the openings.

* * * * *